United States Patent [19]

Lee

[11] Patent Number: 4,679,762

[45] Date of Patent: Jul. 14, 1987

[54] FORM SET-UP

[76] Inventor: Yuan-Ho Lee, No. 851, Chung-San Road, Nan-Pao Tsun, Kuei-Jen Hsian, Tainan Hsieng, Taiwan

[21] Appl. No.: 681,778

[22] Filed: Dec. 14, 1984

[51] Int. Cl.[4] ..... B28B 7/30; E04B 1/16; E04G 11/06

[52] U.S. Cl. ..... 249/26; 249/27; 249/152; 249/180; 249/181; 264/33

[58] Field of Search ..... 264/31, 33, 333, 334; 249/26, 27, 180, 181, 152, 162, 184

[56] References Cited

U.S. PATENT DOCUMENTS

| | | | |
|---|---|---|---|
| 2,544,297 | 3/1951 | Callan | 249/27 X |
| 3,614,054 | 10/1971 | Beasly | 249/27 X |
| 3,934,808 | 1/1976 | Aizawa | 249/27 |
| 4,252,292 | 2/1981 | Armas | 264/333 X |

FOREIGN PATENT DOCUMENTS

| | | | |
|---|---|---|---|
| 2531284 | 1/1977 | Fed. Rep. of Germany | 249/27 |
| 2489206 | 3/1982 | France | 249/26 |
| 765485 | 9/1980 | U.S.S.R. | 249/26 |

*Primary Examiner*—Jan H. Silbaugh
*Assistant Examiner*—Karen D. Kutach
*Attorney, Agent, or Firm*—Sughrue, Mion, Zinn, Macpeak, and Seas

[57] ABSTRACT

An apparatus for forming a multisided upright concrete wall with inner and outer form set-ups including an arrangement for stripping said inner form set-up which has a multisided form wall from the cast concrete entirely which comprises at least one wedge means dividing at least one side of the form wall into two portions and wedged in between the two portions in a first direction during casting, and means for moving the wedge means in a second direction opposite to the first direction after casting and bringing the two portions to be nearer relative to one another, whereby the inner form set-up contracts and therefore entirely is spaced apart from the cast concrete.

4 Claims, 20 Drawing Figures

FORM SET-UP

BACKGROUND OF THE INVENTION

This invention relates to a form set-up, particularly to a form set-up for a building which can be stripped and taken away from a molded concrete structure without disassembling constituting form panels and then reset in another location for next molding.

It is known that the erection of a form for forming concrete in constructing a building is a job which consumes time and labor. In order to economically construct a building, there have been proposed various methods for assembling mold panels into a form set-up which does not require disassembling of the constituting mold panels when it is stripped from the molded structure and which can be conveyed entirely by lifting equipment or the like to be reset in another location for the next molding.

In a typical method for constructing an apartment building, the inner form and outer form are so set up that the ceiling and two side walls of each apartment are cast simultaneously. In such an arrangement, since the inner form set-up is required to be removed from the inner sides of the ceiling and the walls by drawing them out with equipment in a horizontal direction, the removing operation is made only when the molded concrete structure is hardened, to avoid damaging the surfaces of the molded concrete. In addition, the inner form set up can not be removed from the molded structure and conveyed as a whole for resetting in another location.

SUMMARY OF THE INVENTION

An object of the invention is to provide an inner form set-up that can be used for casting a multisided upright wall of a building with an arrangement for stripping it from the cast wall as a whole, thereby facilitating the operation and reducing time consumption.

This and other objects can be achieved in accordance with the invention through the provision of an arrangement for stripping an inner form set-up which includes a multisided vertical form wall. The arrangement comprises at least one wedge means dividing at least one side of said form wall into two portions and wedged in between said two portions in a first direction. When the wedge means is moved in a second direction opposite to the first direction, the divided portions are brought nearer, thereby reducing the distance between the divided portions of the form wall that is spaced by the wedge means. As a result, the inner form set-up slightly contracts and separates from the cast concrete.

In one aspect of the invention, the wedge means includes two first wedge members secured to the divided portions and a second wedge member wedged in between the first wedge members in a first direction. There are further provided longitudinal guide apertures in the second wedge member and fixed guide rods secured to the first wedge members. The fixed guide rods are extended into the guide apertures in part. When the second wedge member is moved upward, the movement of the guide apertures relative to the guide rods causes the second wedge member to move in a second direction, thereby contracting the inner form set-up.

In another aspect of the invention, the wedge means includes a wedge member wedged in between said divided portions and in the wedge member there is provided, a horizontal shaft, on which are mounted worm wheels which are then put into mesh with rack members provided in the first wedge members. When the shaft is rotated, the wedge member is moved in the second direction.

The presently exemplary preferred embodiments will be described in detail with reference to the accompanying drawings, in which:

BRIEF DESCRIPTION OF THE INVENTION

DETAILED DESCRIPTION OF THE PREFERRED EMBODIMENT

Figure 1:
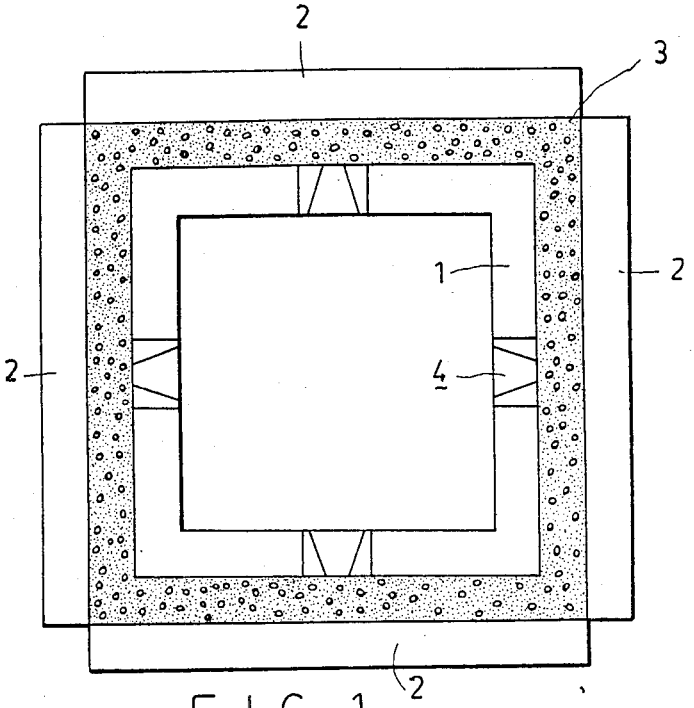
FIG. 1 is a schematic view showing a four-sided inner form set-up used in forming a four-sided concrete wall provided with a wedge assembly.
Figure 2:
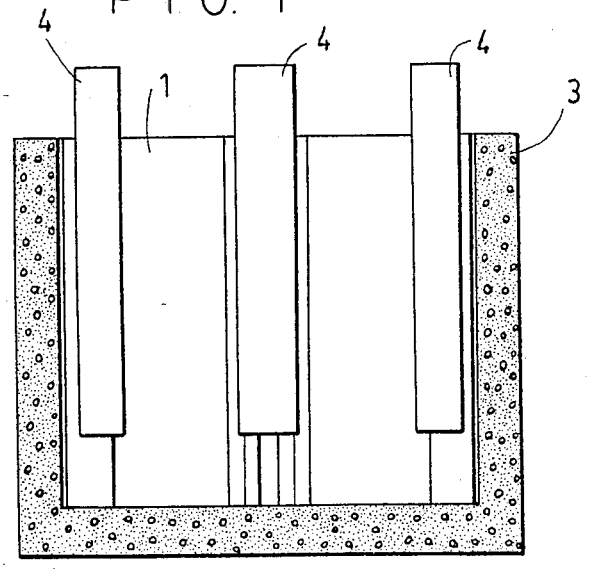
FIG. 2 is a schematic view showing the wedge member which is drawn upward from the form set-up.
Figure 3:
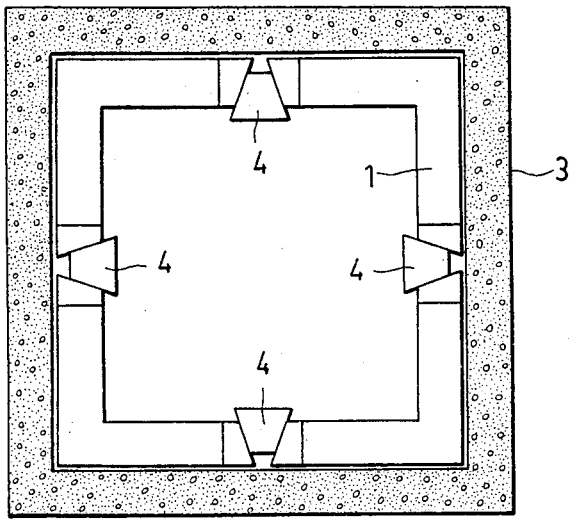
FIG. 3 is a schematic view showing that the members are moved outward and the inner form set-up is stripped from the molded concrete wall.

Referring to FIGS. 1, 2 and 3, there is illustrated a four sided closed wall 3 formed within an inner form set-up 1 and four outer form set-ups 2. Each form set-up 1 or 2 is constituted of a plurality of steel panels. The inner form set-up 1 includes two pairs of opposite vertical form walls each of which incorporates a wedge assembly 4 extending from the top to the bottom of the form set-up 1. The wedge assembly 4 is incorporated in the form set-up 1 in such a manner that, when it is drawn upward, as shown in FIG. 2, one wedge member in the wedge assembly 4 will move outwardly so that the form set-up 1 contracts slightly and separates from the inner surface of the molded concrete wall as shown in FIG. 3. This facilitates the operation of a lifting equipment to lift the form set-up 1 as a whole to another location. The construction thereof will be described in detail hereinafter.

Figure 4:
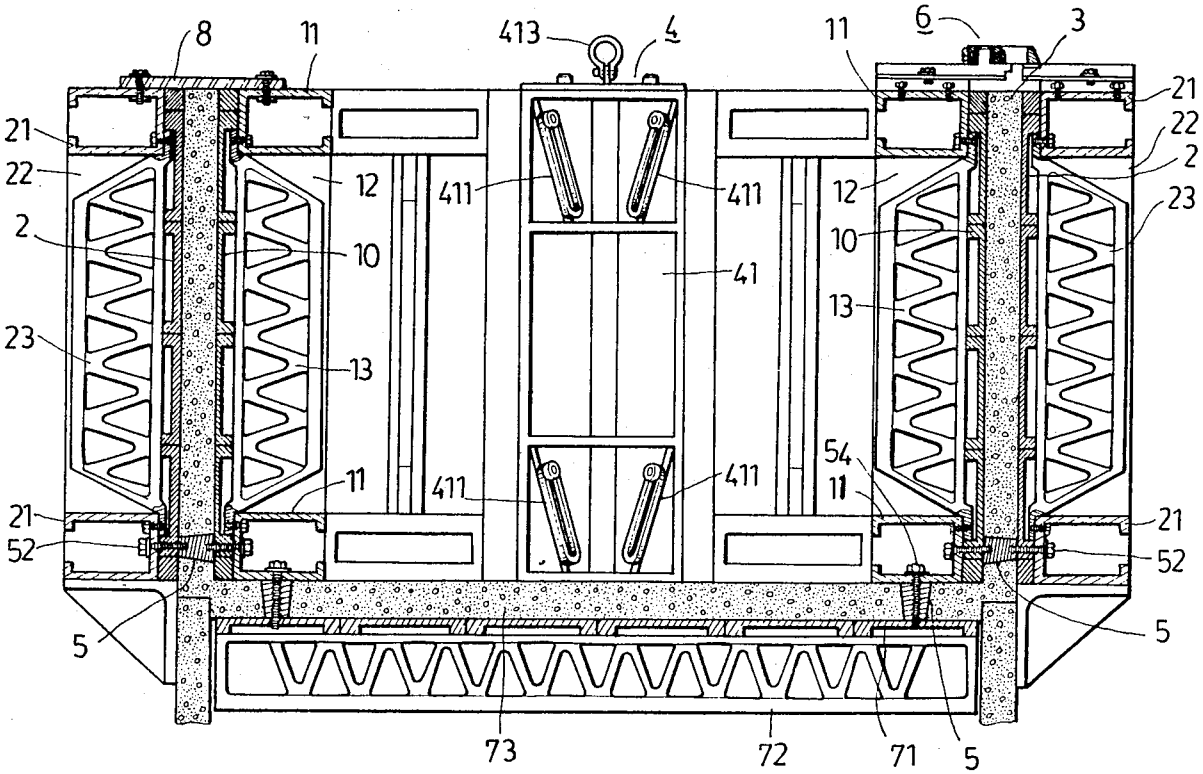
FIG. 4 shows in greater detail the arrangement of the inner form set-up and multiple outer form set-ups.

FIG. 4 illustrates the inner form set-up 1, the outer form set-ups 2 and a floor form set-up 71 which are assembled together to form a concrete floor 73 and a four sided concrete wall 3. The inner form set-up 1 is constituted of panels 10, angled batters 11, vertical batters 12, form reinforcing beams 13, etc., and is placed above the floor form set-up 71 which is positioned on girders 72 and is supported by and screwed to conical inset bodies 5 with bolts 54.

The outer form set-ups 2 are constituted by using angled batters 21, vertical batters 22 and reinforcing beams 23. They are suspended to the inner form set-up 1 by means of hangers 6 which are disposed above the form set-up 1. The construction of the hanger 6 will be described in detail hereinafter. Alternatively, the outer form set-up 2 can be connected to the inner form set-up 1 by using bars 8. The lower portions of the form set-ups 2 are fastened to the lower portion of the form set-up 1 by means of bolts 54 and truncated cone shaped insert bodies 5. The insert bodies 5 are removed from the concrete structures after casting and the hollows left are filled with concrete.

Figure 5:
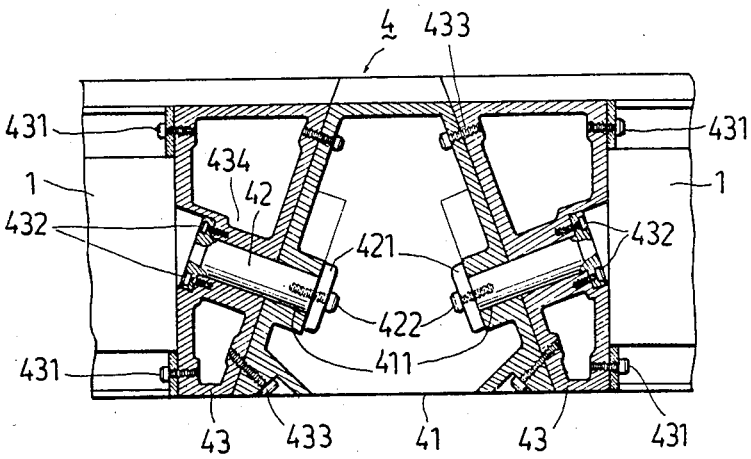
FIG. 5 shows in greater detail a wedge assembly having guide apertures and guide rods.

Referring to FIGS. 4 and 5, the wedge assembly 4 provided in each side of the inner form set-up 1 divides said side into two portions and spaces said two portions. It includes a wedge member 41 and two wedge members 43. The wedge member 41 is provided with four guide longitudinal apertures 411 at the upper and lower parts of its two inclined sides that are in abutment with the inclined sides of the wedge members 43. Each of the guide apertures 411 has an inclination relative to a vertical axis. Each of the wedge members 43 is provided with two fixed guide rods 42 which are extended in part into the apertures 411. The wedge members 43 are respectively secured to the adjacent divided portions of the form wall by means of screws 431. The guide rods 42 which are extended into the guide apertures 411 are provided with caps 421 and bolts 422. They are inserted in bores 434 provided in the wedge members 43 and are fastened thereto by means of screws 432. It can be noted that the wedge member 41 is movable relative to the wedge members 43, since the guide rods 42 are slidable in the guide apertures 411. There are further provided screws 433 for fastening the wedge member 41 to the wedge members 43.

Figure 6:
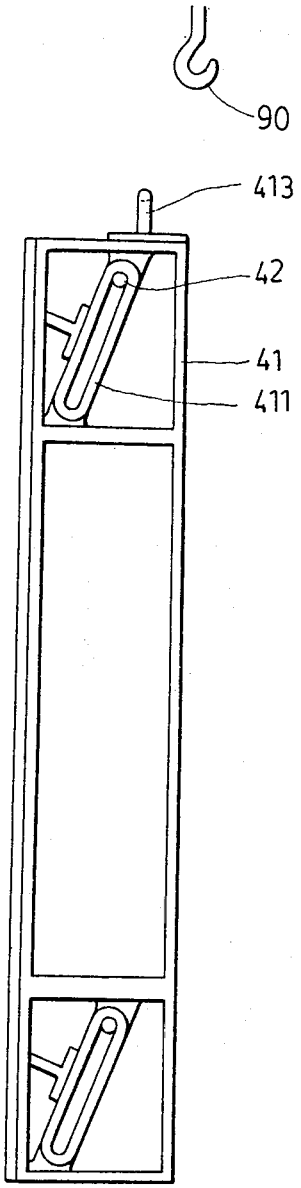
FIG. 6 shows the positions of the guide rods relative to the guide apertures before the second wedge member is drawn upward.
Figure 7:
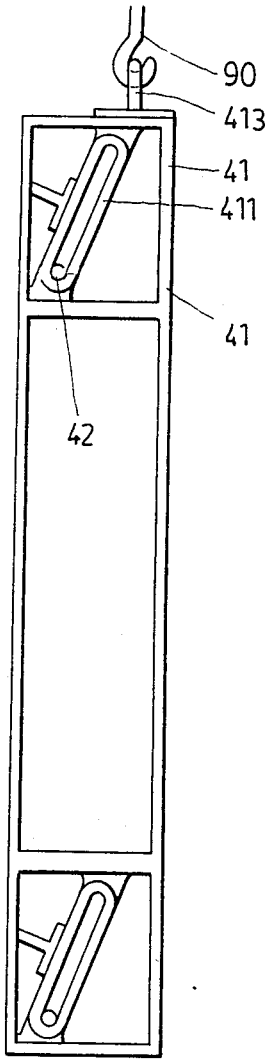
FIG. 7 shows the positions of the guide rods relative to the guide apertures when the second wedge member is drawn upward.
Figure 8:
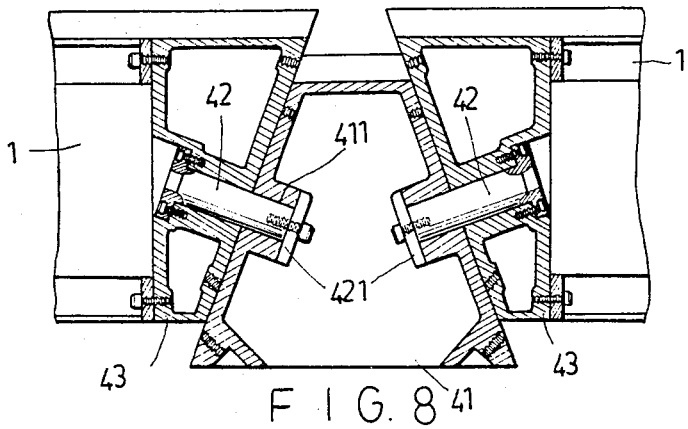
FIG. 8 is a sectioned top view showing that the second wedges are moved outward.
Figure 13:
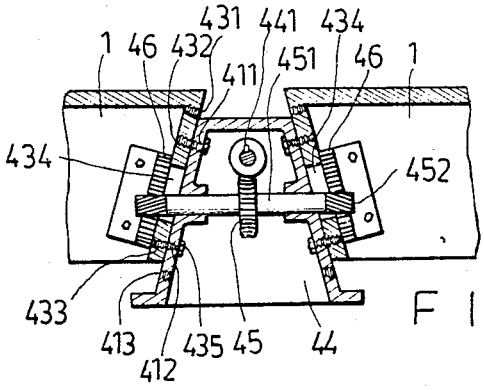
FIG. 13 is a sectioned view taken along the line 13—13 of FIG. 11.
Figure 14:
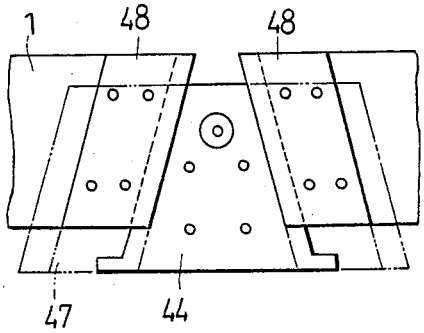
FIG. 14 is a fragmentary top view of FIG. 11 after the guide plate is removed.

Referring to FIGS. 6, 7, and 8, to strip the inner form set-up 1 from the inner sides of the concrete wall 2, a lifting equipment having lift hooks 90 each of which is attached to the hook 413 provided at the top of each wedge member 41. At the begining of the lifting operation, since the wedge members 41 are in a movable relationship with the wedge members 43, they will be drawn upwards prior to the movement of the whole form set-up 1. Simultaneously with the upward movement of the wedge members 41, the wedge members 41 are moved horizontally outward from the wedge assemblies 4 respectively due to the movement of the guide apertures 411 relative to the guide rods 42. This makes the wedge members 43 of each wedge assembly 4 to move toward one another and results in the contraction of the form set-up 1 in all sides due to the displacement of all divided portions of the form set-up 1 which are spaced by the wedge assemblies 4. Due to the contraction, the form set-up 1 separates from the surfaces of the concrete wall. It should be noted that screws 433 are removed during the lifting operation.

Figure 9:
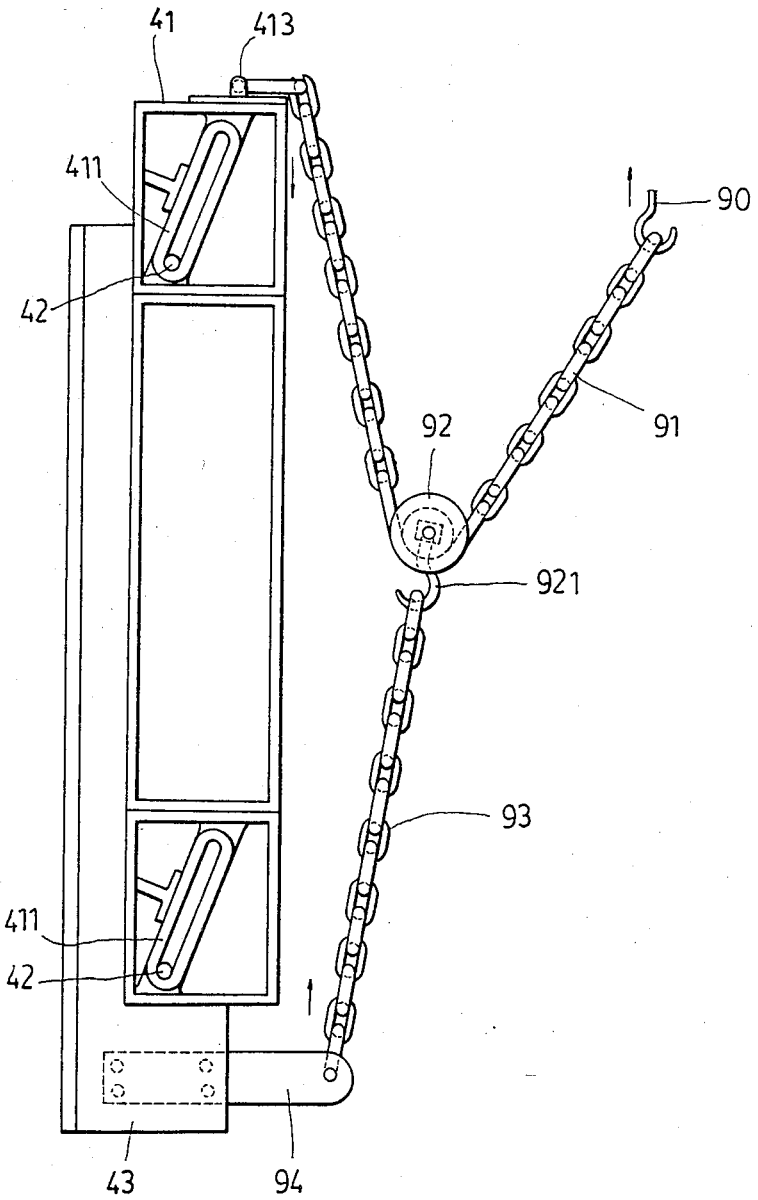
FIG. 9 is a view showing a means for wedging in the second wedge member between the first wedge members.

When the form set-up 1, after removal from the molded concrete wall is located in another location, each wedge member 41 can be wedged in between the wedge members 43 in a manner as shown in FIG. 9. The wedge member 41 is hung on the lifting hook 90 by using a chain 91 that is attached to the hook 413 and is passed over a pulley 92 and a chain 93 that is attached to the hook 921 of the pulley 92 and a connecting rod 94 affixed to the lower sides of the wedge members 43. When the chain 91 is pulled upward, the wedge member 41 is moved into between the wedge members 43.

Figure 10:
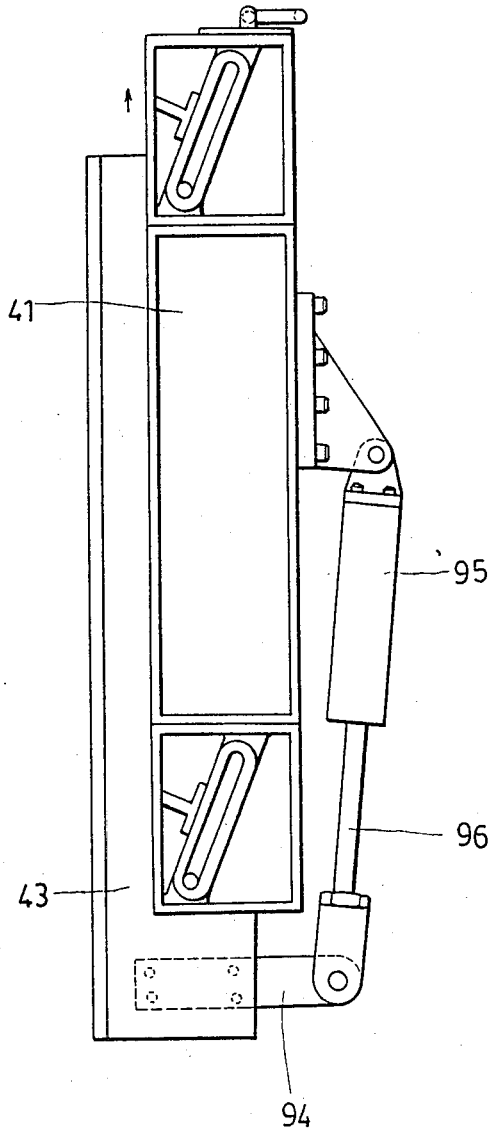
FIG. 10 is a view showing a hydraulic cylinder used for moving the second wedge member upward.
Figure 11:
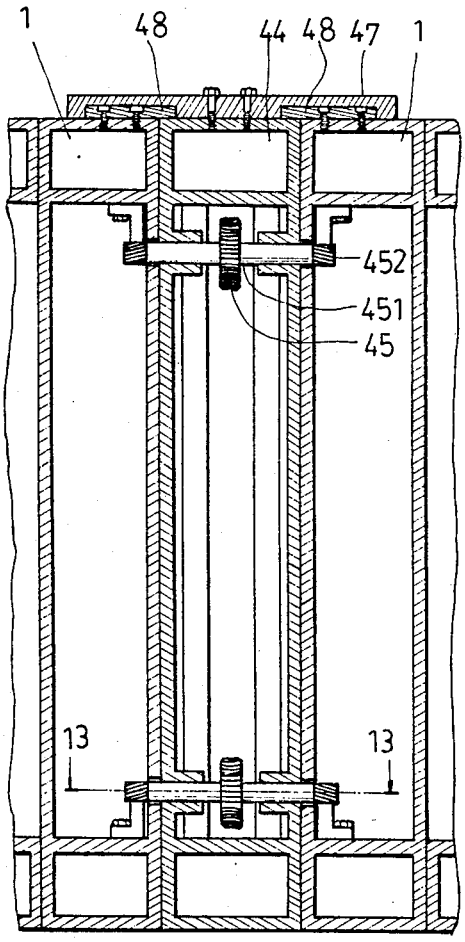
FIG. 11 is a sectioned view showing the wedge member provided with worm wheels and rack members.
Figure 12:
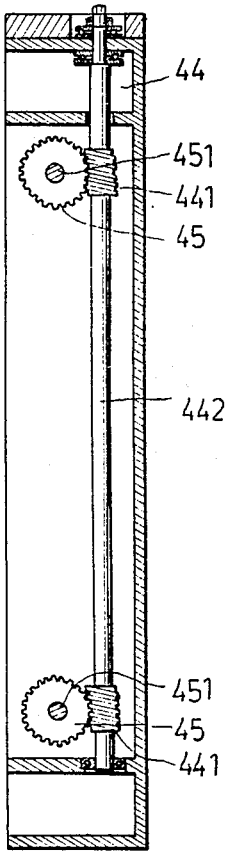
FIG. 12 is a sectioned view showing the wedge member of FIG. 11 in another position.

The wedge member 41 can also be moved upward by using a hydraulic cylinder 95, as shown in FIG. 10. The hydraulic cylinder 95 is attached to the wedge member 41 and a piston rod 96 is attached to the connecting rod 94 provided at the lower portion of the wedge members 43. When the hydraulic cylinder 95 operates, the wedge member 41 will move upward simultaneously with its outward movement.

An alternative means that causes the form set-up 1 to separate from the surfaces of the molded concrete is illustrated in FIGS. 11, 12, 13 and 14. This means includes a wedge member 44 wedged in between two divided portions of the form set-up 1, a vertical shaft 442 on which is mounted two worms 441 at the upper and lower portions of the wedge member 44, two worm wheels 45 which are put into mesh with the worms 441 respectively mounted on two horizontal shafts 451. Each shaft 451 is journalled in two inclined sides of the wedge member 44 and its two ends are extended into the divided portions of the form set-up 1 through apertures 434. On the extended ends of the shafts 451 are provided two worm wheels 452 respectively which are put into mesh with rack members 46 provided in the form set-up 1. There are further provided slots 411, 412, and 413 in the inclined sides of the wedge member 44 and slots 431, 432 and 433 provided in the inclined sides of the divided portions of the form set-up 1 for receiving screws 435 which are used to fasten the wedge members 44 and the form set-up 1 when the converged portion of the wedge member 44 is projected outward or retracted.

There is further provided, a guide plate 47, which is secured to the top of the wedge member 44 and two guide blocks 48 in the shape of a rhomboid secured to the top of the form set-up 1 and received in the guide grooves provided at the bottom side of the guide plate 47.

When the shaft 442 is driven by an external drive means, the motion of the shaft 442 is transmitted to the worm wheels 452 which in turn drives the rack members 46, thereby moving the wedge member 44 outward. While the wedge member 44 moves outward, the guide plate 47 brings the two guide blocks 48 to be nearer, thereby reducing the distance between the divided portions of the form set-up 1 and contracting the form set-up 1. When the wedge 44 is to be driven into the form set-up 1, the shaft 442 can be rotated in a direction opposite to that causes the wedge 44 to move outward.

Figure 15:
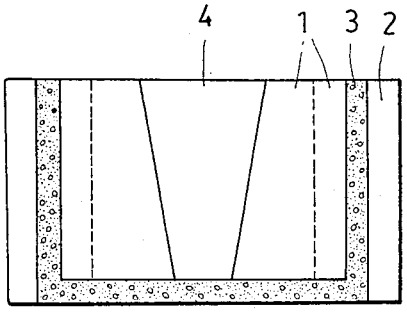
FIG. 15 is a view showing a wedge member of which the lower portion is tapered.
Figure 16:
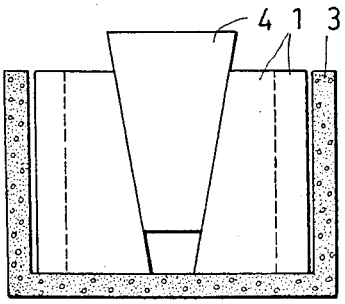
FIG. 16 is a view showing the wedge member of FIG. 15 after being drawn upwards.
Figure 17:
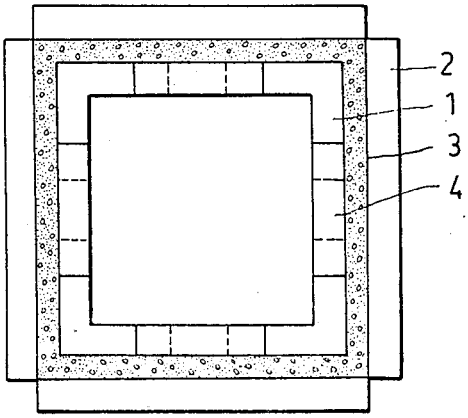
FIG. 17 is a top view showing the inner form set-up provided with the wedge member of FIG. 15.

FIGS. 15, 16 and 17 shows another example of the wedge means that can make the form set-up 1 contract. It differs from the aforementioned wedge assembly in such a manner that the wedge member is wedged in from the top side to the bottom side of the form set-up 1. It offers the same effect as the aforementioned wedge assembly when it is pulled upward.

Figure 18:
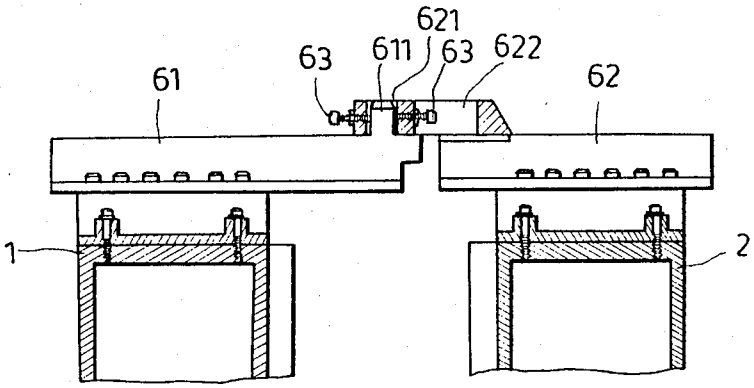
FIG. 18 is a fragmentary view showing a hanger.
Figure 19:
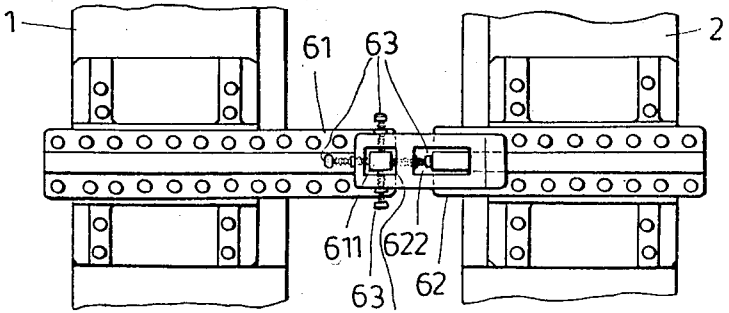
FIG. 19 is a schematic fragmentary top view showing the hanger.

FIGS. 18 and 19 shows in greater detail of the hanger 6 which has been described with reference to FIG. 4. The hanger 6 includes a support bar 61 which is secured to the top of the form set-up 1 and a support bar 62 which is secured to the top of the form set-up 2. The support bar 61 is provided with a protrusion 611 of square-shaped cross-section, and the support bar 62 is provided with a socket 621 of square-shaped cross-section and a socket 622 of rectangle shaped cross-section. There are further provided clamping screws 63 for the socket 621. When the socket 621 is sleeved onto the protrusion 611 and the clamping screws 63 are tightened, the form set-up 2 is hung on the form set-up 1.

Figure 20:
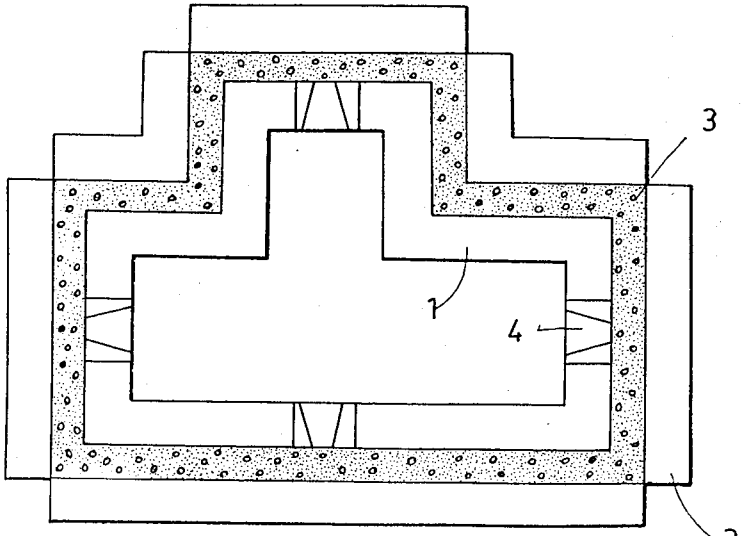
FIG. 20 is a schematic top view showing an inner form set-up having more than four sides.

In addition to the inner form set-up 1 which has a four-sided form wall as hereinbefore described, the inner form set-up 1 may also be in the form as shown in FIG. 20.

With the invention thus explained, it is apparent that various modifications and variations can be made without departing from the scope of the invention. It is therefore intended that the invention be limited as indicated in the appended claims.

I claim:

1. An inner form set-up for molding the inner surfaces of a closed multi-sided concrete wall structure comprising:

vertical form walls connected to each other, each of said form walls acting to mold one side of the concrete wall structure, each form wall comprising two portions;

wedge means provided between said two portions of each of said form walls and extending vertically along the full length of said form wall, said wedge means including two first wedge members each having a first vertical panel fixedly abutting one of said portions, a second vertical panel connected to said first panel and flush with a molding surface of said portions of said form wall, and a third vertical panel connected to said second panel and inclined to said first and second panels, and a second wedge member for insertion horizontally between said first wedge members to place said form walls in a molding position and for retraction outward to contract said form walls, said second wedge member having two opposite first panels which are inclined at the same inclination to that of said third panels of said first wedge members and a second panel interconnecting said first panels of said second wedge member;

a rack-and-gear mechanism interengaging said first and second wedge members for moving said second wedge member horizontally relative to said first wedge members; and guide means for causing said two portions of each of said form walls to approach each other or to move away from each other when said second wedge member moves.

2. An inner form set-up as claimed in claim 1, wherein said guide means includes two guide blocks of trapezoid shape secured to the top of said first wedge members respectively, and a guide plate secured to the top of said second wedge member, said guide plate overlapping said guide blocks and having guide grooves conforming to the shape of said guide blocks for receiving said guide blocks and for moving said guide blocks.

3. An inner form set-up as claimed in claim 1, wherein said rack-and-gear mechanism includes a horizontal shaft which is mounted in said second wedge member and which terminates in two ends passing through said first panels of respective second wedge member, first worm wheels mounted on said two ends, rack members respectively horizontally fixedly mounted on said first wedge members, in mesh with said first worm wheels, and means for rotating said horizontal shaft.

4. An inner form set-up as claimed in claim 3, wherein said means for rotating said horizontal shaft includes a second worm wheel mounted on the intermediate portion of said horizontal shaft, a vertical shaft rotatably mounted in said second wedge member for rotation about its axis, a third worm wheel mounted on said vertical shaft and meshed with said second worm wheel, and a power means for driving said shaft.

* * * * *